United States Patent [19]

Tabar

[11] Patent Number: 4,885,192

[45] Date of Patent: Dec. 5, 1989

[54] DEVICE FOR PRODUCING THREE DIMENSIONAL LANDSCAPE SCENES

[76] Inventor: William J. Tabar, 4845 Wren Cir. #2, Salt Lake City, Utah 84117

[21] Appl. No.: 78,913

[22] Filed: Jul. 27, 1987

[51] Int. Cl.[4] ..... G09F 19/00

[52] U.S. Cl. ..... 428/13; 428/14

[58] Field of Search ..... 428/13, 14, 331, 913.3, 428/131

[56] References Cited

U.S. PATENT DOCUMENTS

| | | | |
|---|---|---|---|
| 1,255,001 | 1/1918 | Flammer | 428/14 |
| 1,711,701 | 5/1929 | Speck | 428/14 |
| 2,404,136 | 7/1946 | Knauff | 428/13 |
| 3,819,436 | 6/1974 | Allen | 428/13 X |
| 3,992,811 | 11/1976 | Yellin | 428/13 X |
| 4,031,643 | 6/1977 | Templeton | 428/13 |

FOREIGN PATENT DOCUMENTS

| | | | |
|---|---|---|---|
| 3526978 | 5/1986 | Fed. Rep. of Germany | 428/13 |
| 2172136 | 9/1986 | United Kingdom | 428/13 |

*Primary Examiner*—Nancy A. B. Swisher

*Attorney, Agent, or Firm*—Thorpe, North & Western

[57] ABSTRACT

A device for producing a three dimensional landscape scene within a sand/fluid environment. The device comprises a pair of plates having opposing interior surfaces which define an enclosed plate volume. These surfaces are separated by a distance of 0.02 to 0.06 inches to create a controlled environment conductive for random flow of a variety of sand or particle materials with differing densities and particle sizes. Particular particle sizes and dimensions are provided to enable resolution of colors as the particles fall within the fluid by force of gravity. Three dimensional detail is developed by reason of fine contrast particles cooperating in combination with shading particles and moderate sized particles all entrained within the liquid medium.

36 Claims, 3 Drawing Sheets

DEVICE FOR PRODUCING THREE DIMENSIONAL LANDSCAPE SCENES

BACKGROUND OF THE INVENTION

1. Field of Invention

This invention relates to devices for creating sand pictures between opposing plates of glass having upright orientation. More specifically, the present invention relates to devices for creating landscape scenes utilizing sand or other other particulate matter suspended in a liquid medium between opposing plates of glass in an upright frame.

2. Prior Art

The utilization of various colors of sand to create pictures and other forms of art work has long been practiced, starting with ancient indian civilizations. In modern times, sand paintings have been created within an enclosed area between upright plates wherein various colors of sand are dispersed at different levels to create landscape scenes and other forms of art work. In some instances these forms of sand painting have filled the entire void space between the opposing plates of glass, which are then sealed around the periphery to lock the sand or particulate matter in fixed position as a permanent rendition of art work.

More recently, devices have been developed which suspend the sand particles in a liquid medium between plates of glass, with the sand filling only a portion of the empty volume between the opposing plates. When in vertical orientation, the sand settles into the lower portion of the plate volume, leaving the liquid in the remaining upper portion. By inverting the plate, the sand particles diffuse through the liquid medium and create a new form of art work, as the sand particles reposition themselves by sedimentation in response to the force of gravity.

More recently, air bubbles have been added to the sand/liquid material. The effect of such air bubbles is to create a nonuniform resistance against movement of the sand from the top of the plate toward the lower plate volume after the plate has been inverted. Upon inversion, the air bubbles rise to encounter the partition line of sand and liquid and restrain movement of such sand particles by the counter force of buoyancy in opposition to the force of gravity. By using sands of different densities, the variety of swirl patterns within the sand is increased.

Although such prior art devices create colorful and interesting patterns of sand formations, the devices have not been able to reproduce the fine and detailed art work of sand paintings produced by methodical introduction of sand into the void space by an artisan in the absence of a liquid environment. For example, whereas dry sand art work produces fine lines of color delineation, the liquid environment of the prior art produces only general sand patterns which lack the distinctive features of dry sand work.

Such dry sand productions can develop a three dimensional effect which has not been replicated with the random sand movement through a fluid and air bubble combination. To the contrary, the scenes developed by current sand, water and gas devices remain of a two-dimensional effect, characterized by the absence of detailed features and variation which enhances the three-dimensional result.

OBJECTS AND SUMMARY OF THE INVENTION

It is therefore an object of the present invention to provide a device and method for creating art work designs with sand, water and air bubbles which create a three-dimensional landscape appearance.

It is a further object of the present invention to provide such a device for creating art work designs which have similar detail and color features as are achieved with dry sand construction, yet in a liquid, random formation environment.

It is a further object of the present invention to provide design art work utilizing sand in a liquid medium which creates landscape scenes with natural contours and geography on a random formation basis.

Yet another object of the present invention is to provide such a device which can be embodied as part of a key ring assembly.

These and other objects are realized in a device for producing an art work design which develops a desired three-dimensional appearance for a randomly formed landscape scene. This device comprises a pair of plates having opposing planar, interior surfaces which are in approximate parallel orientation. Generally, at least one of such plates is visually transparent to permit direct observation of the sand or particle formation. The plates have a preferable separation distance between opposing interior surfaces of approximately .02 to .06 inches and define an inclosed plate volume therebetween. Particulate matter such as sand, enamel or glass beads is disposed within the enclosed volume and operates as the design-forming substance. This particulate matter is comprised of at least two different particle sizes of a composition having at least two different densities. The particulate matter includes (1) shading particles for defining darker features within the design and (2) contrast particles for providing a variety of lighter features in contrast to the darker features. The shading particles have a mesh size within the range of 60 to 150 and usually have a specific gravity within the range of 3.0 to 7.0. The contrast particles have a mesh size in the range of 60 to 240, with a comparable range of specific gravities. The contrast particles include (i) fine particles having a specific gravity of less than 3.0 and mesh sizes within the range of 100 to 240 and (ii) moderate size particles which have a specific gravity of greater than 3.0 and mesh sizes within the range of 70 to 150.

These particles are suspended in a liquid medium which is disposed within the plate volume. Also included within the plate volume is a quantity of buoyancy elements, such as air bubbles, which are entrained within the liquid medium and have a sufficiently small size and a geometric configuration to permit free movement throughout the plate volume. In other words, these elements migrate through the particulate matter and liquid and are sufficient in quantity to enable formation of a substantially continuous line of contiguous buoyancy elements across the full length of the plate volume. These structural components are enclosed within the plate volume by sealed periphery such as silicon. A key ring attachment tab may be included within the framework of the plate structure to facilitate the use of this device as part of a key ring assembly. Furthermore, an injection port may be included to facilitate adjustment of air or other gas form within the particle/liquid/gas composite.

Other objects and features of the present invention will become apparent to those skilled in the art based upon the following detailed description, taken in combination with the following drawings.

DETAILED DESCRIPTION OF THE INVENTION

The present invention literally adds a new dimension to prior liquid/sand/gas devices for creating sand designs between verticle plates in upright orientation. In essence, the present invention creates three-dimensional images by developing greatly enhanced detail within the sand scene. This is in direct contrast with two-dimensional appearances of the prior art devices.

Figure 1:
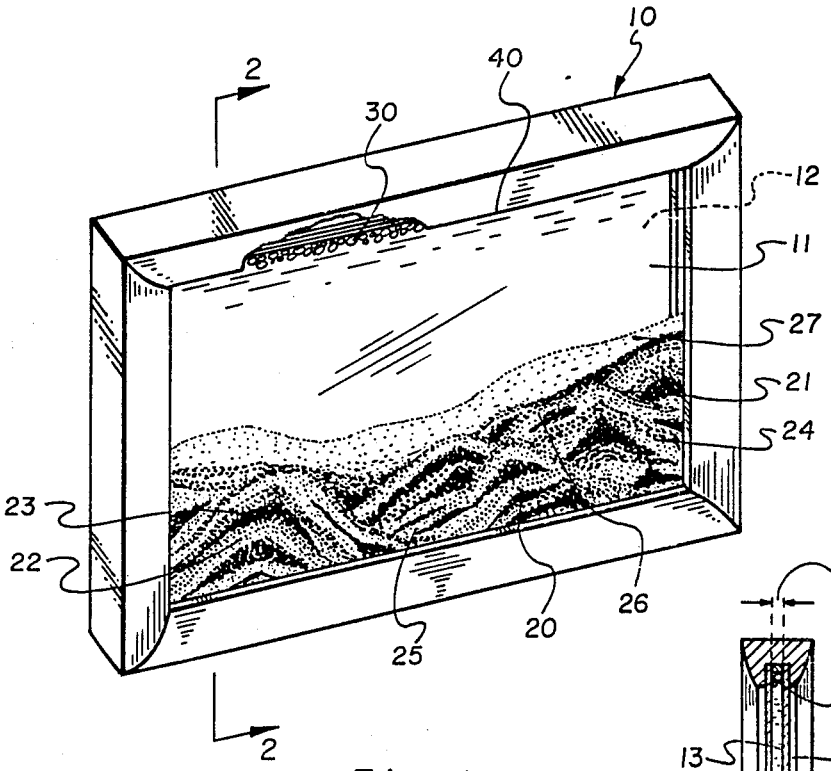
FIG. 1 shows a partial cut away perspective view of a framed device constructed in accordance with the present invention.

This present invention is illustrated in FIG. 1 as item 10. The device includes a pair of plates of glass 11 and 12 which have opposing planar, interior surfaces 13 and 14 in approximate parallel orientation. Although most plates are illustrated as transparent, only one plate need be visually transparent to accomplish the objectives of providing a visual art display. Such plates might also be constructed of plastics or other materials suitable for the intended art work. The present inventor has discovered that a number of factors may be controlled to enhance the detail developed by the random movement of sand within the enclosed plate volume 15 between the opposing interior surfaces 13 and 14.

One such feature is the separation distance 16 between these plate surfaces. Specifically, it has been discovered that if the separation distance is reduced from prior art separation distances which are of values greater than 0.07 inches, improved resolution occurs, particularly in combination with other features disclosed herein. Accordingly, the separation distance 16 illustrated in the FIGS. is defined to be a distance between the values of 0.02 and 0.06 inches, and preferably approximately 0.03 inches.

When this limitation of separation distance between plate surfaces is adopted, a surprising increase to color resolution in sand formations is realized, based on the effect of such separation in combination with other features disclosed hereafter. For example, the thinner channel enables better capture and support of sand or particulate matter against flow. This operates to reduce the rate of sand movement to much slower velocities than previously experienced. These slower velocities enable better sand formation in differentiated layers which fine lines and other features realized where multicolors of sand are used. It also enables better differential flow between the air bubbles which retain some of the particulate matter in a suspended state. Where differing densities of sand are applied, greater enhancement of color separation occurs. Furthermore, the thinner channel offers a significant increase to the number of flow channels for sand which can develop between suspending air bubbles. The greater number of flow channels provides further enhancement of color separation needed to realize a three-dimensional appearance.

In addition to the reduced separation distance between plate surfaces, a specific selection of sand or particulate matter is required. This particulate matter has generally been limited to sand or similar mineral compositions having a variety of colors. The present inventor has discovered that in addition to sand and similar mineral compositions, significant improved design art work can be realized with powdered enamels, resins and also with glass beads. Further discussion as to the basis for selection and choice of particulate matter is provided hereafter. In general, the particulate matter operates as the design-forming medium or material. Obviously, it must have a density greater than the liquid medium in which it is entrained. Generally, multiple densities are preferred in order to develop variable design forms. This results from gravitational forces which accelerate particles having heavier densities with respect to those of lighter density. In addition, particle movement is also controlled by utilizing particles of different size.

The particulate matter selected is disposed within a portion of the enclosed volume 16 and is comprised of particles having at least two different particle sizes and of compositions of at least two different densities. These particles are shown entrained in the lower portion 17 of the plate volume 16 in FIG. 2.

The particulate matter is generally divided into two classifications. The first classification includes shading particles which provide darker features within the design art work. For example, in FIG. 1, shading particles are represented as item 20, 21, 22 and 23. It will be apparent to those skilled in the art that such particles are typically not totally isolated from other particles but may be intermixed with remaining particulate matter. These shading particles will generally have a mesh size within the range of 60 to 150 and a specific gravity within the range of 3.0 to 7.0. This combination of particle size and density enables the particle to operate within the fluid environment in response to gravity and opposing buoyancy forces of air bubbles or the like to give proper placement and variation within the overall design. The more preferred range of mesh size for shading particles is 70 to 90, with best results being realized with a chromite material of 70/80 mesh and having a specific gravity of 4.7. Generally, the shading particles will comprise 15 to 75 percent by volume of the total particulate matter within the plate volume 16. The present invention performs best with a shading particle composition in the range of 40 to 60 percent by volume of the total particulate matter. With the systems illustrated in the present application, shading particles comprised 50 to 55 percent by volume of the total particulate matter.

In order to develop the desired three dimensional effect, a composite of contrast particles are used as illustrated at points 24, 25, 26 and 27. Obviously, these identified locations are merely examples of a comprehensive occurrence of these particles throughout the design format. The function of the contrast particles is to provide a variety of lighter features in intermixed colors which contrast with the darker features of the shading particles.

Typically, the contrast particles will have a plurality of mesh sizes which fall within the range of 60 to 240. Similarly, a plurality of specific gravities for such particles will exist and will generally be within the range of 3.0 to 7.0.

The contrast particles are generally divided into two categories. The first category comprises fine particles which have a specific gravity of approximately 3.0 or less and a general mesh size within the range of 150 to 240. This class of fine particles is best illustrated by item 27 which is the lightest color within the design of FIG. 1. Although the maximum limits of fine particles within the contrast powder extends from 10 to 80 percent by volume of the total contrast particle composition, color separation and three-dimensional effect are enhanced as one reduces the range to 20 to 70 percent, and preferably to 40 to 60 percent of the total contrast particle composition.

When the fine particulate contrast particles exceed 80 percent of the total composition, the system fails to respond because the fine particles or powder pack too tightly and move too slowly to enable proper random dispersion and movement of the particulate matter generally. Failure to include at least 10 percent of the fine particulate material results in loss of fine line delineations within the resulting design pattern. Without such lines, the three dimensional effect is never achieved.

Figure 7:
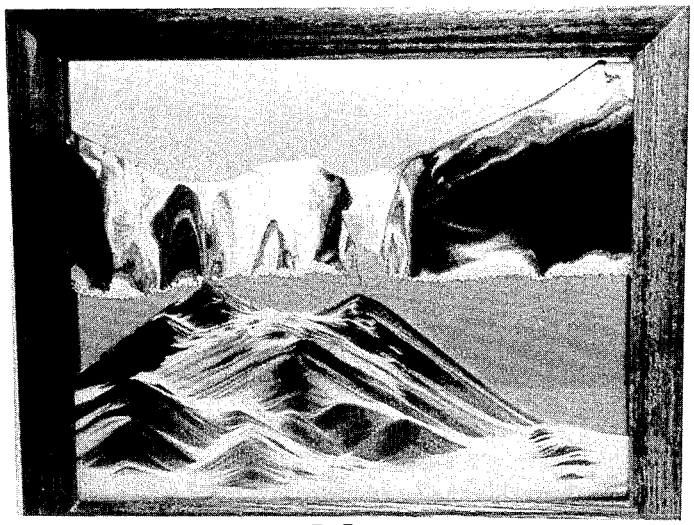
Figure 8:
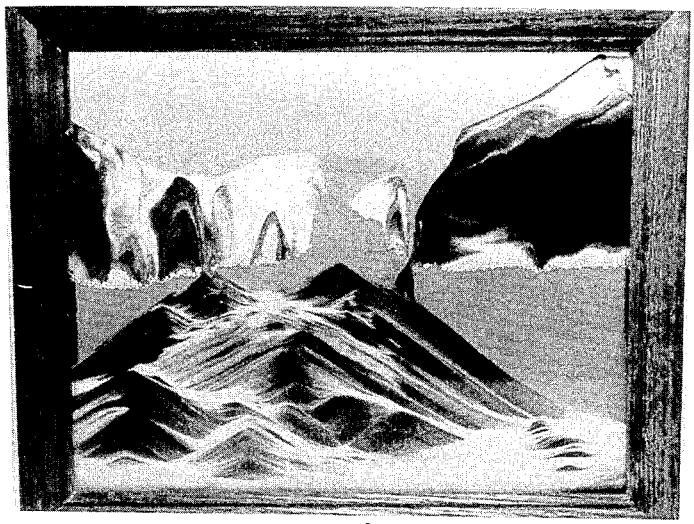
Figure 9:
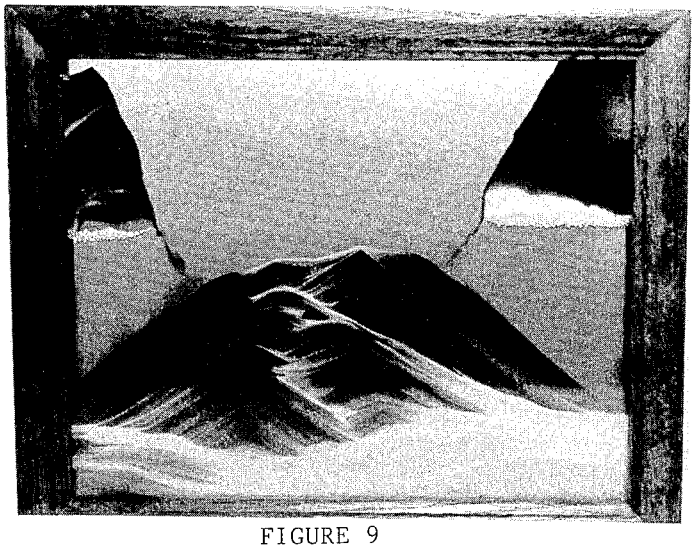

For example, the fine powders referred to herein are shown in FIGS. 4 through 9 as the white portions of the design. These white portions comprise a 200 mesh silica powder. This silica has a specific gravity of less than 3.0 and is so fine that upon inversion of the device, this powder assumes the appearance of a milkey substance within the liquid medium. Because of its fine size, gravitational affects its movement more slowly than the larger sand particles comprising the shading material. The fine detail created by the white lines of this component is clearly manifest in FIGS. 6 through 9. In FIG. 9, the top white layer of particulate matter which rests in the approximate middle-vertical section illustrates the fine contrast particles which settle from the liquid medium after the remaining larger particulate matter has been formed into the landscape scene. This upper layer of fine particles creates an unusual and esthetically pleasing top edge to the landscape scene which has a fading effect, giving an appearance of skyline merging into the liquid medium above the landscape scene. Further discussion of the operation of the fine white contrast particles will be provided later within the context of a description of the design sequence revealed in FIGS. 4 through 9.

A second category of contrast particles includes moderate sized particles having a specific gravity greater than 3.0 and a mesh size approximately within the range of 70 to 150. Generally, these moderate size contrast particles will have a specific gravity within the range of 4.0 to 5.5 and will thereby operate with increased movement rates as compared to the fine contrast particles previously discussed. A preferred range of sizes for this category of particles is 100 to 130 mesh. The examples illustrated in the attached FIGS. show moderate particle sizes having 120 mesh size and being comprised of silica. Because of their more rapid movement, the moderate size contrast particles migrate with the shading particles to create a variety of color combinations and design effects. These are represented generally by the regions numbered 24, 25 and 26. The darker areas such as 26 include increased concentration of the shading powder as compared to the lighter areas 24. Such color contrasts are also apparent with respect to the sequence FIGS. of FIG. 4 through FIG. 9.

Generally, the contrast particles will comprise the remaining volume of particulate matter not included within the shading particles. Accordingly, this would consist of 85 to 25 percent by volume. More preferably, the composition of contrast particles will be approximately 40 to 60 percent volume of the total particulate matter. The actual selection of relative compositions will be based upon the desired contrast of dark versus light colors and the overall dominant dark versus light design appearance desired.

As with shading particles, contrast particles can be selected from a variety of particulate mineral matter such as sand, silica and chromite. In addition, the present inventor has discovered that enamel powders, glass beads and resin powders offer unusual flowability and enhanced color resolution within the present field of invention. For example, a green enamel powder may be utilized within the definition of moderate size particles to develop a forest-green appearance within the art work. Similarly, particulate resin materials can be formed and may offer similar varieties of color and density. In addition, glass beads may be utilized within the limitations set forth for moderate sized particles.

The addition of glass beads provides other advantages for enhancement of the three-dimensional effects realized in this invention. For example, glass beads have a spherical symmetry which promotes flowability of other particulate matter surrounding such beads. Use of glass beads therefore functions to lubricate the flow of particles and to develop an improved balance of slower versus faster particle migration. Such a balance is essential if the fine detail lines illustrated in the FIGS. are to be realized. Typically, the range of glass beads will extend from 10 to 40 percent by volume of the total contrast particle composition. A more preferred range is approximately 25 to 30 percent by volume.

The three-dimensional effect realized in the FIGS. contained in this disclosure were achieved with a contrast particle composite made up of approximately six parts fine particulate silica of 200 mesh, with the moderate particle composition including two parts silica of 120 mesh and three parts fine glass beads. This combination of particle sizes and densities realizes an unusually refined scene, despite its random formation within the fluid environment.

An additional necessary element within the present system is the buoyant material previously accomplished by utilization of air or gas bubbles. The present inventor has identified other forms of buoyancy elements which may be utilized within the present invention and has accordingly adopted this term, as opposed to prior art use limited to gas bubbles.

Figure 2:
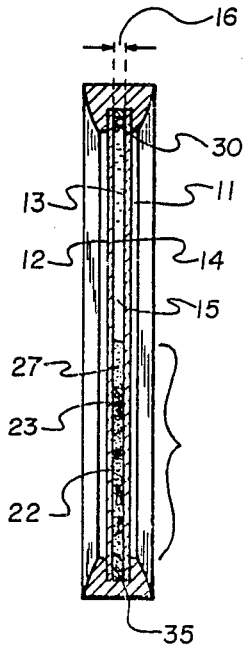
FIG. 2 shows a cross section of the device of FIG. 1, taken along the lines 2—2.

The buoyancy elements or gas bubbles illustrated in FIGS. 1 and 2 as item 30 are entrained within the liquid medium which fills the remaining plate volume. These elements or bubbles must have a sufficiently small size and geometric configuration to permit free movement throughout the plate volume and within the particulate matter and liquid. The quantity should be sufficient to enable formation of a substantially continuous line across a full length of the plate volume, as is illustrated at item 30 in FIG. 1. Although the remaining portion of this line of bubbles is concealed under the frame 40, it is to be understood that the bubbles extend from the left side to the right side of the device.

As is illustrated in the FIGS. (particularly FIGS. 4 through 8) the small bubbles operate to support the combination of particulate matter in its superior suspended condition, allowing small strains of sand to pass between bubbles and through other wider gaps to form the peaks and hills of the landscape design. Valleys are formed by virtue of limited sand or particle movement where the support of the buoyancy elements or bubbles is most effective. This is particularly clear in FIG. 8, where a central mountain is flanked by the upper suspended portions of particulate matter on the left and right sides.

Prior art systems have been limited to the use of gas bubbles which are unpredictable in size and shape, and which tend to change in volume, based on temperature variations. The present inventor has discovered that other buoyant elements may provide advantages over the prior use of gas. For example, spherical bodies of solid material such as styrofoam and other buoyant polymers may be utilized. These have the advantage of constant size and predetermined shape. Such buoyant elements are illustrated, for example, in FIG. 3 which comprises a key chain embodiment of the present invention. Other forms of buoyant elements will be apparent to those skilled in the art in view of the present disclosure.

Finally, the liquid medium which is utilized within the system fills the remaining content of the plate volume. Typically, this liquid comprises water with a detergent additive. The detergent additive provides increased flowability to the particulate matter, based on the effects of surfactants within the detergent. The liquid may also include a dye for providing color tint to contrast with the colors of the particulate matter. In some cases, an ammonia or other dye stabilizing composition is appropriate within the liquid. In the embodiments illustrated in the FIGS., the liquid composition is comprised of water, detergent and ammonia in the ratio of approximately 320:4:1.

The combination of liquid, particulate matter, and buoyancy element is sealed within the plate volume by use of a silicon adhesive or other means for forming a peripheral edge around the plate volume. This element is illustrated as item 35 in FIG. 2. Because of changes of temperature, and other effects, it may be necessary to adjust the quantity of buoyancy element where this element comprises gas bubbles. Accordingly, the present invention includes the use of a hypodermic needle 36 as a means for adjusting fluid and gas content to provide the proper balance of gas within the system. Other forms of injection port may be envisioned by those skilled in the art.

Figure 3:
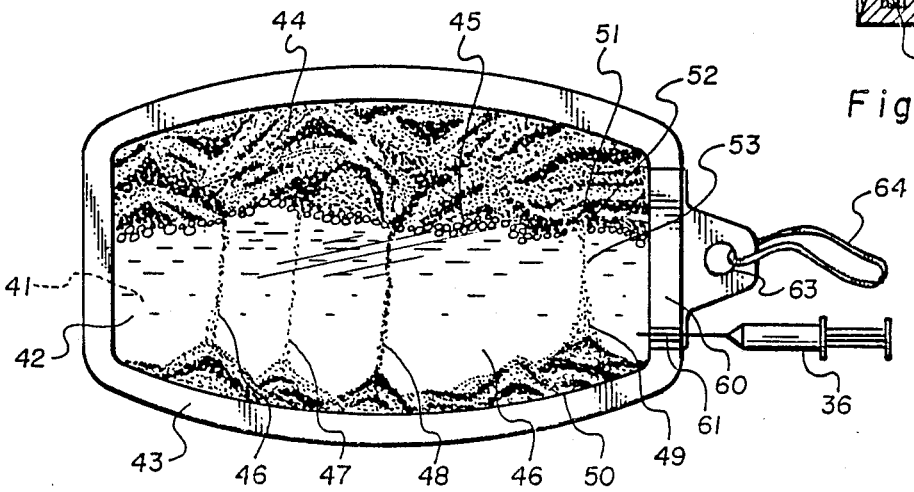
FIG. 3 illustrates an embodiment of the present invention constructed in the form of a key chain assembly.

FIG. 3 illustrates an embodiment of the present invention which comprises part of a key chain assembly. This includes the pair of opposing plates 41 and 42 and the peripheral sealing means 43 which encloses the plate volume. Within this plate volume are the various sand or particulate matter compositions 44, the buoyancy elements 45 and liquid composition 46. The present embodiment illustrated in FIG. 3 is graphically shown as having just been inverted, with spaced trains of particulate matter 46, 47, 48 and 49 being pulled by gravity to the lower plate volume location 50. Where higher density particulate matter 51 exists near the buoyancy elements 52, a flow surge 53 develops, causing a swirling pattern and rapid movement of the particulate matter (shading particles) toward the base 50. The desired three-dimensional effect is realized by the variety of flow patterns and the corporation of fine particles with moderate particles as part of the described system.

The present key chain embodiment illustrates the use of an insert plug 60 which is sealed within the periphery of the device and includes a recessed channel 61 for injection of gas. This channel communicates from the interior of the plate volume to an exterior location enabling access for the injection means 36. As the insert plug 60 is sealed within a peripheral bead of silicon adhesive captured between the peripheral edge 43 of the device, the channel 61 is also filled with silicon. This port is then useful for receiving the needle portion of the injection means 36 to effect transfer of gas or liquid as is necessary. The insert plug is further adapted with a opening 63 enabling attachment of a key chain 64 or other device as part of a key chain assembly.

In this application of the present invention, the separation distance between opposing plates 41 and 42 is slightly enlarged. The present illustration is set at approximately 0.06 inches separation distance to enhance movement of the particulate matter within the liquid medium. This is useful for objects smaller in size such as a key chain assembly, whereas the narrower separation distance is appropriate for framed pictures of significantly greater surface area such as is illustrated in FIG. 1.

Figure 4:
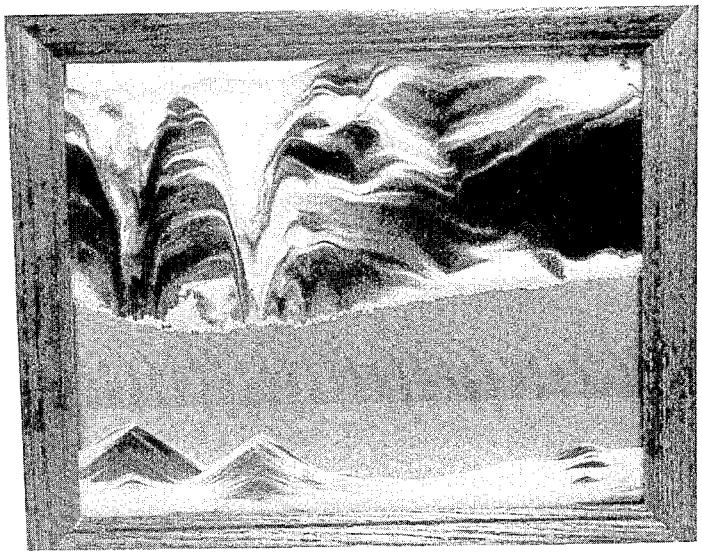
FIGS. 4 through 9 illustrate a sequence of sedimentation formation of art work designs as would be realized in the device illustrated in FIG. 1.

FIGS. 4 through 9 illustrate a sequence of six photographs taken shortly after inversion of a framed device similar to that shown in FIG. 1. For example, FIG. 4 illustrates the initial formation of several series of three-dimensional peaks at the lower left corner, with a concurrent formation of a peak in the right hand side. The three dimensional landscape effect is illustrated by the variations in shading particles which occur immediately below and to the left of the right hand peak. These landscape designs are being randomly formed by reason of a proper balance of sand compositions as described herein, with the space limitations which are also set forth.

Figure 5:
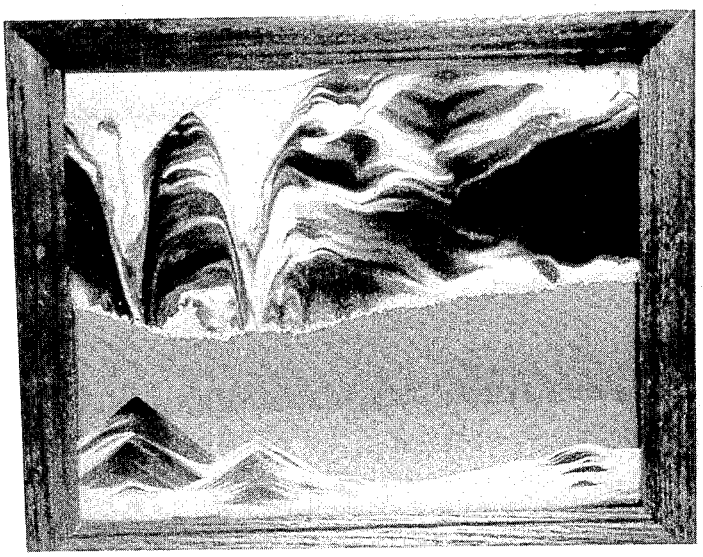
Figure 6:
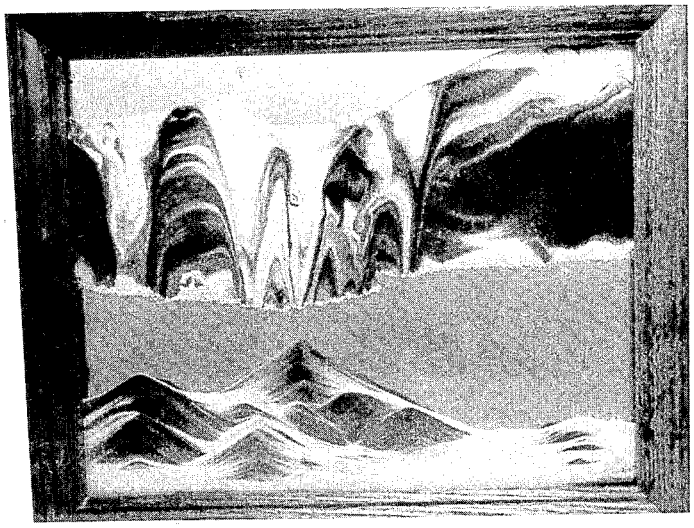

The gradual development of the landscape scene continues in FIG. 5 and FIG. 6, as variations in particle flow occur based on variations in density, particle size and bubble location below the suspended particles. In FIG. 7, the central portion of the bubble line is about to be breached as the sand passes through, enabling the bubbles to float upward to the top of the frame. At this point, the sand spills from its center starting point toward each respective side as is illustrated in FIG. 8. Following the loss of bubble support, the shading particles and moderate sized contrast particles fall to their various resting positions. Finally, the remaining fine silica contrast particles settle over the top of the landscape scene and provide the image and appearance of FIG. 9.

It will be apparent to those skilled in the art that variations in composition and structure within the principles of the present invention may be applied. Accordingly, the scope of the present invention is to be determined by the following claims, and not by examples which represent specific embodiments set forth herein.

I claim:

1. A device for producing an artwork design having an appearance resembling a three-dimensional landscape scene, said device comprising:

a pair of plates having opposing planar, interior surfaces in approximate parallel orientation, at least one of said plates being visually transparent;

said plates having a separation distance between the opposing planar interior surfaces of between 0.02 and 0.06 inches, thereby forming an enclosed plate volume;

particulate matter disposed within a portion of the enclosed volume and being operable as design-forming material, said matter being comprised of particles having at least two different particle sizes and of compositions of at least two different densities;

said particulate matter including (i) shading particles for defining darker features within the design and (ii) contrast particles for providing a variety of lighter features in contrast to the darker features;

said shading particles having a mesh size within the range of 60 to 150 and a specific gravity within the range of 3.0 to 7.0;

said contrast particles having a plurality of mesh sizes within the range of 60 to 240 and a plurality of specific gravities within the range of 3.0 to 7.0;

said contrast particles including (i) fine particles having a specific gravity of less than 3.0 and mesh sizes within the range of 150 to 240 and (ii) moderate sized particles having a specific gravity of greater than 3.0 and mesh sizes within the range of 70 to 150;

a liquid medium disposed within the plate volume in combination with the particulate matter, said liquid being inert with respect to the particulate matter;

a quantity of buoyancy elements entrained within the liquid medium and having a sufficiently small size and geometric configuration to permit free movement throughout the plate volume and within the particulate matter and liquid, said quantity being sufficient to enable formation of a substantially continuous line of contiguous buoyancy elements across a full length of the plate volume; and means for sealing a peripheral edge of the plate volume to retain the liquid/particulate/buoyancy element mixture therein.

2. A device as defined in claim 1, wherein the shading particles comprise 15 to 17% by volume of the total particulate matter, said contrast particles comprising the balance of particulate matter.

3. A device as defined in claim 2 wherein the shading particles comprise 40 to 60% by volume of the total particulate matter.

4. A device as defined in claim 2 wherein the shading particles comprise approximately 50 to 55% by volume of the total particulate matter.

5. A device as defined in claim 1, wherein the mesh size of the shading particles is within the more specific range of 70 to 90.

6. A device as defined in claim 1, wherein the shading particles comprise chromite material of 70/80 mesh and having a specific gravity of approximately 4.7.

7. A device as defined in claim 1, wherein the particulate matter is selected from the group comprising sand, silica, chromite, enamel powder, glass beads, and resin powders.

8. A device as defined in claim 1, wherein the particulate matter comprises enamel powder.

9. A device as defined in claim 1, wherein the particulate matter comprises resin powders.

10. A device as defined in claim 1, wherein the particulate matter comprise glass beads.

11. A device as defined in claim 1, wherein the composition of contrast particles is approximately 40 to 60% by volume of the total particulate matter.

12. A device as defined in claim 1, wherein the fine particles comprise 10 to 80% of the contrast particles.

13. A device as defined in claim 1, wherein the fine particles comprise 20 to 70% of the contrast particles.

14. A device as defined in claim 1, wherein the fine particles comprise 40 to 60% of the contrast particles.

15. A device as defined in claim 1, wherein the contrast particles are selected from the group comprising sand, silica, chromite, enamel powder, glass beads, and resin powders.

16. A device as defined in claim 1, wherein the fine contrast particles comprise fine silica of approximately 200 mesh.

17. A device as defined in claim 1, wherein the moderate sized contrast particles have a specific gravity within the range of 4.0 to 5.5.

18. A device as defined in claim 1, wherein the moderate sized contrast particles have a mesh size within the range of 100 to 130.

19. A device as defined in claim 1, wherein the moderate sized contrast particles comprise silica of approximately 120 mesh.

20. A device as defined in claim 1, wherein the moderate sized contrast particles includes glass beads.

21. A device as defined in claim 1, wherein the moderate sized contrast particles includes 10 to 40% glass beads by volume of total contrast particles.

22. A device as defined in claim 21, wherein the moderate sized contrast particles includes 25 to 30% glass beads by volume of total contrast particles.

23. A device as defined in claim 22, wherein the relative composition of fine, moderate and glass bead particles making up the total contrast particle material is in the ratio of 6:2:3 respectively.

24. A device as defined in claim 1, wherein the buoyant elements comprise gas bubbles entrained within the liquid.

25. A device as defined in claim l, wherein the buoyant elements comprise spherical bodies of solid material.

26. A device as defined in claim 1, wherein the solid material comprises buoyant polymers.

27. A device as defined in claim 1, wherein the liquid includes a detergent in a water solvent.

28. A device as defined in claim 27, wherein the detergent comprises Bioterg 803.

29. A device as defined in claim 28, wherein the liquid further includes ammonia with a dye composition to provide color tint to the liquid.

30. A device as defined in claim 29, wherein the relative compositions of water, detergent and ammonia are in the ratio of approximately 320:4:1.

31. A device as defined in claim 1, said device further including an injection port including means for introducing gas to the sealed plate volume.

32. A device as defined in claim 31, wherein the means for sealing the peripheral edge of the plate volume includes an insert plug having a recessed channel communicating from the plate interior to an exterior location, said channel including means for injection of the gas for adjusting gas content within the plate volume.

33. A device as defined in claim 32, wherein the insert plug includes an external opening for attachment of a key, thereby adapting the device as part of a key chain.

34. A key chain device as defined in claim 33, wherein the plate separation distance is approximately 0.06 inches.

35. A device for producing an artwork design having an appearance resembling a three-dimensional landscape scene, said device comprising:

a pair of plates having opposing planar, interior surfaces in approximate parallel orientation, at least one of said plates being visually transparent, said plates forming an enclosed plate volume;

particulate matter disposed within a portion of the enclosed volume and being operable as design-forming material, said matter being comprised of particles having at least two different particle sizes and of compositions of at least two different densities;

said particulate matter including (i) shading particles for defining darker features within the design and (ii) contrast particles for providing a variety of lighter features in contrast to the darker features;

said shading particles having a mesh size within the range of 60 to 150 and a specific gravity within the range of 3.0 to 7.0;

said contrast particles having a plurality of mesh sizes within the range of 60 to 240 and a plurality of specific gravities within the range of 3.0 to 7.0;

said contrast particles including (i) fine particles having a specific gravity of less than 3.0 and mesh sizes within the range of 150 to 240 and (ii) moderate sized particles having a specific gravity of greater than 3.0 and mesh sizes within the range of 70 to 150;

a liquid medium disposed within the plate volume in combination with the particulate matter, said liquid being inert with respect to the particulate matter;

a quantity of buoyancy elements entrained within the liquid medium and having a sufficiently small size and geometric configuration to permit free movement throughout the plate volume and within the particulate matter and liquid, said quantity being sufficient to enable formation of a substantially continuous line of contiguous buoyancy elements across a full length of the plate volume; and means for sealing a peripheral edge of the plate volume to retain the liquid/particulate/buoyancy element mixture therein; and an insert plug disposed within the peripheral edge and including an external opening for attachment of a key, thereby adapting the device as part of a key chain.

36. A device as defined in claim 35, wherein the insert plug includes a recessed channel communicating from the plate interior to an exterior location, said channel including means for injection of the gas for adjusting gas content within the plate volume.

* * * * *